United States Patent [19]

Rignon et al.

[11] Patent Number: 4,830,717

[45] Date of Patent: May 16, 1989

[54] PROCESS FOR ELECTROREDUCTION OF ALIPHATIC NITRO DERIVATIVES

[75] Inventors: Maurice Rignon, Givry; Jean Malafosse, Saint Marcel, both of France

[73] Assignee: L'Air Liquide, Societe Anonyme pour l'Etude et l'Exploitation des Procedes Georges Claude, Paris, France

[21] Appl. No.: 180,053

[22] Filed: Apr. 11, 1988

[30] Foreign Application Priority Data

Apr. 16, 1987 [FR] France ..... 87 05428

[51] Int. Cl.[4] ..... C25B 3/04

[52] U.S. Cl. ..... 204/74

[58] Field of Search ..... 204/74

[56] References Cited

U.S. PATENT DOCUMENTS 2,485,982 10/1949 McMillan ..... 204/74

4,678,549 7/1987 Rignon et al. ..... 204/74

FOREIGN PATENT DOCUMENTS 0198722 10/1986 European Pat. Off. .

1185024 7/1959 France .

*Primary Examiner*—John F. Niebling

*Assistant Examiner*—David G. Ryser

*Attorney, Agent, or Firm*—Browdy and Neimark

[57] ABSTRACT

A process for reducing aliphatic nitro compounds to the corresponding nitroalcohols. Chemical electroreduction is performed on a bimetallic cathode consisting of a copper support metal and a zinc or cadmium active element.

10 Claims, No Drawings

PROCESS FOR ELECTROREDUCTION OF ALIPHATIC NITRO DERIVATIVES

FIELD OF THE INVENTION

This invention relates to a process of electroreduction of aliphatic nitro compounds.

BACKGROUND OF THE INVENTION

The reduction of the group $—NO_2$ by the pair $Fe—Fe^{++}$ in a sulfuric acid or acetic acid medium is known, but the weight of the reagent used is about three times that of the nitro derivative to be reduced. A large amount of solid residue to be eliminated results and it is necessary to rectify the liquid containing the amine to obtain a pure product. The yield is on the order of 80%.

It is also possible to perform a catalytic hydrogenation, for example, on Raney nickel in a methanol medium under 6 MPa at 40°-45° C.

In this case also, the yield does not exceed 80%; the secondary reactions are numerous, involving the formation of light amines and heavy residue which must be separated from the desired amino alcohol by several successive rectifications which involve considerable investment and energy consumption; further, it is not possible to avoid the formation of the $N\text{-}CH_3$ derivative which is then difficult to separate from the desired nitro derivative.

A process of electrochemical reduction has already been described in U.S. Pat. No. 2,485,982 according to which the operation is performed in an aqueous hydrochloric or sulfuric solution in an electrochemical cell provided with a porous porcelain diaphragm; an aqueous solution of amino alcohol hydrochloride and sulfate is obtained which then must be neutralized and/or precipitated to obtain the amine. In addition to the raw material derivative, the acid and neutralization or precipitation reagents are consumed which then must be rejected into the environment.

In French application No. 2,577,242 the applicant described a process for reduction of nitro alcohols into amino alcohols in a diaphragm cell in which the anode and cathode compartments are separated by a cation-exchange membrane; the catholyte consists of an aqueous sulfuric solution of nitro alcohol and the anolyte of a dilute sulfuric acid solution.

It is possible to represent this transformation overall by two reactions:

$$RNO_2+4e-+4H^+—R\text{-}NHOH+H_2O \quad (1)$$

$$R\ NHOH+2e-+2H^+—R\text{-}NH_2+H_2O \quad (2)$$

Reaction (1) is performed at an electronegative potential close to −0.8 volts. It can be used on a large number of materials with a slight hydrogen overvoltage such as stainless steel, copper, or nickel.

Reaction (2), on the other hand requires a potential close to or greater than −1.5 volts; it can be performed only on materials with a large oxygen overvoltage to favor the reduction of the —NHOH group relative to that of the proton. Choice of the material is then limited to four or five metals such as mercury, lead, zinc, cadmium, tin and materials with a carbon base such as graphite and vitreous carbon.

Good results have been obtained on lead and on mercury amalgams, and on copper, nickel and lead.

But this process has several drawbacks. It was found that it was not possible totally to avoid corrosion of the cathode, which results in contamination of the amino alcohol obtained with traces of mercury or of lead toxic cations. Further, a deactivation of the cathode surface was observed; in the best case this deactivation occurs after several dozen hours of operation and thus makes the process unsuitable for industrial use.

SUMMARY OF THE INVENTION

A process of electrochemical reduction nitro compounds to form the nitro alcohols was sought, according to which the corresponding chemical reactions are used on a metal cathode, immersed in the catholyte which is an aqueous or aqueous-alcoholic sulfuric solution or emulsion of the nitro alcohol derivative.

The cathode consists of a support metal and of an active element which, depending on the potential metal will be either in solution in cationic form or reduced to metal constituting a metal deposit on the support metal.

The choice of support metal is rather wide; it will be made from elements for which the equilibrium potential $$M^{n+}+ne^-—Mo \quad (3)$$

is clearly less electronegative than the potential of reaction (1), thus guaranteeing the inalterability of the support metal; further, the support metal will be endowed with a high electrical conductivity; copper and nickel are particularly well suited.

The active element will be selected from the elements for which the equilibrium potential of reaction (3) is between the potentials of reactions (1) and (2); further, when the active element is in the Mo state, the metal surface thus achieved should be such that the hydrogen overvoltage there be as high as possible so that reaction (2) is favored there relative to the reduction of the proton; finally, the active element, in the ($M^{n+}$) state should be soluble in the catholyte.

Zinc and cadmium are elements well suited to this use.

Preferably zinc will be selected because of the slight toxicity of the $Zn^{++}$ cation.

According to the invention, the process of electrochemical reduction of aliphatic nitro compounds is used with reactivation of the cathode. The active element has the property of changing state according to the potential of the support metal, and of being in cationic form in solution in the catholyte or in metallic deposit form on the support metal so that these transformations are obtained simultaneously with the successive reduction reactions of the nitro derivative and they cause, at each operation, a complete renewal of the electroactive surface with a large hydrogen overvoltage.

The electrodeposition of the active element on the support metal is performed under good conditions when the amount of metal cation present in an operation is between 1 and 10 millimoles per $dm^2$ of cathode, preferably 2 to 6 millimoles.

The invention can be practiced in the following way given by way of example.

A cell with two separate compartments is used.

In a first electrolysis operation, a copper cathode is immersed in a nitro alcohol sulfuric aqueous solution to which is added a small amount of soluble salts of zinc ($Zn^{++}$), cadmium ($Cd^{++}$); an electric current is established and maintained between the two electrodes so that the reduction reaction of the $—NO_2$ group are performed at a sufficient speed; the copper cathode then takes a potential which progressively increases with the development of the organic electroreduction into —NHOH then into —$HN_2$ to a value more electronegative than the potential of equilibrium (3); the cation is then reduced and is transformed into metal deposit constituting on the copper a surface with a large hydrogen overvoltage on which the reduction of the proton will be inhibited to the benefit of the transformation into amine of the hydroxyl amine group. When the reduction to amine is completely finished, passage of the current is stopped; the catholyte is emptied; it is replaced by a new charge of nitro derivative sulfuric solution and passage of the current is reestablished with a suitable intensity; at the end of this second operation, the active element will pass into solution in the form of $Zn^{++}$ or $Cd^{++}$ to be redeposited again when the cathode potential has reached a value more electronegative than the potential of equilibrium (3).

These alternations of solubilization and electrochemical deposits cause, at each operation, a complete renewal of the electroactive surface and thus preserves its efficiency indefinitely and integrally.

The same result is obtained if, in the initial operation, a plate of copper or nickel previously galvanized or cadmium-coated is used as a cathode; the metal deposit passes into solution in the form of $Zn^{++}$ or $Cd^{++}$ cations at the beginning of the operation then the cation in solution is reduced to a metal deposit simultaneously with the transformation of the hydroxyl amine to amine.

The description of the transformation of a nitro derivative to an amino derivative by means of said successive reactions (1 and 2) seems to be able to be considered as too diagrammatic. It is generally admitted that reaction (1) can easily be used under such conditions that the current efficiency (faradic efficiency RF) is very high (RF=95–100%); and, as soon as it is made to react 4 F (faraday) per mole of nitro derivative, the reduction becomes more difficult and instantaneous efficiency of the current is greatly reduced, so that the overall faradic efficiency diminishes more rapidly as the amount of efficient electricity approaches 6 F/mole corresponding to a total conversion of the nitro derivative to amine function.

Now, by operating with cathode materials with large hydrogen overvoltage, particularly on copper-zinc or copper-cadmium cathodes described above, with the cathode medium subjected to electrolysis having such a composition that the acidity ratio $H^+/RX(RX=R\text{-}NO_2+R\text{-}NHOH+R\text{-}NH_2)$ is suitably selected, it has been found that there is a superposition of the two organic electroreduction reactions and that the amine function appears well before any nitro derivative is completely transformed to hydroxylamine.

On the Cu-Zn or Cu-Cd cathodes it is found that it is possible to obtain a very high faradic efficiency, close to 95–100% until the amount of effective current is on the order of 5.2–5.8 F per mole of initial $R\text{-}NO_2$; then the instantaneous efficiency of the current diminishes rapidly; this can be ascribed to the increasingly higher dilution of the molecules remaining to be reduced.

The efficiency of the current is closely linked to the acidity of the medium defined by the molar ratio $H^+/RX$ $(RX=R\text{-}NO_2+R\text{-}NHOH+R\text{-}NH_2)$, the latter should be kept in the interval 1 to 1.5, preferably remain close to 1.1; care should be taken that it remains constant during the entire length of the operation, in particular at the end of the operation.

The catholyte temperature can be between 10° and 100° C., preferably between 20° and 60° C.

The optimal cathode current density is not closely linked to the transformation used; it can be selected to obtain the maximum productivity of the apparatus, taking into account the maximum current density supportable without deterioration by the membrane and of the unit energy consumption, which depends to a large extent on the geometric structure of the cell.

The process is applicable to aliphatic nitro compounds, in particular to aliphatic nitro alcohol compounds represented by the formula:

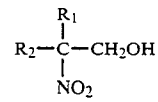

in which $R_1$ and $R_2$ together or separate are hydrogen, a hydroxyl radical, such as hydroxymethyl, or a linear or branched alkyl radical, in particular, methyl, ethyl, propyl or containing a number of carbon atoms greater than three.

These products include nitro compounds which can be reduced to form industrially important alkanol amines such as 2-amino-2-methyl-1-propanol, 2-amino-2-methyl-1,3-propanediol, 2-amino-2-ethyl-1,3-propanediol, tris(hydroxymethyl)aminomethane, 2-amino-1-butanol.

Examples which illustrate the invention in a nonlimiting way are given below.

EXAMPLES 1 TO 3

The object of these three examples is the reduction of tris(hydroxymethyl)nitromethane into the corresponding amino derivative.

A cell is used comprising three parallelepipedic compartments separated by two partitions made up of a sulfonic type cation-exchange membrane sold under the trademark "Ionac 3470" (Ionac company), consisting of a polypropylene support and cation exchange sites; the cathode is placed in the central compartment and two anodes consisting of ruthenium-coated titanium plate are placed in the outside anode compartments.

The anolyte is a 20% sulfuric acid solution. The operation is at a constant intensity corresponding to a cathode current density of 10 $A/dm^2$ (amperes per square decimeter). The charge of material to be reduced is 150 millimoles of nitro derivative. The anolyte is stationary, while the catholyte is recycled during the entire test on an outside circuit consisting of a peristaltic pump and a glass exchanger making possible the thermal conditioning of the catholyte. The temperature of the catholyte is kept between 20° and 30° C. during the first stage in which it receives an amount of effective electricity of 4 F/mole; then it is raised to 60° C.

The advance of the reaction is followed by potentiometric analysis of the catholyte which measures the $H^+$, R—NHOH, R—$NH_2$ contents; a semiquantitative metric pH determination makes it possible to establish the presence or disappearance of the nitro derivative.

The operation is stopped when hydroxylamine and, a fortiori, nitro derivative no longer remains in the solution.

According to the technique described in French application No. 2,577,242, the catholyte solution can then be treated by electro-electrodialysis which then can be evaporated dry to obtain the pure amino alcohol.

The material balance made on the catholyte at the end of electrolysis shows a slight loss of organic material that can be determined by potentiometry. Taking this loss into account, the chemical yield of conversion of R—$NO_2$ to R—$NH_2$ is calculated and values varying between 94–98% are obtained.

The cathode is a copper plate; its useful surface is 80 $cm^2$; the voltage between poles varies between 3 and 5 volts.

The results obtained are given in table I below:

TABLE I

| | TEST | | |
|---|---|---|---|
| | 1 | 2 | 3 |
| CATHODE | Cd/Cu | Cu + Cd | Cu + Zn |
| CATHODE POTENTIALS (relative to SCE) | −0.57 V | −0.59 V | −0.54 V |
| initial (at 4° F.) | −0.75 | −0.75 V | −0.75 V |
| final | −1.45 V | −1.34 V | −1.3 V |
| CURRENT EFFICIENCY | 78.8% | 77.4% | 79.4% |
| CHEMICAL YIELD | 94.2% | 94.3% | 94.3% |
| ENERGY CONSUMED (kwg/kg) | 7.5 | 6.9 | 7.2 |

SCE = saturated calomel electrode
F = Faraday
kwh/kg = kilowatt hour per kilogram
V = volt For test 1, the cathode is a copper plate cadmium-coated by standard electroplating processes.

In test 2, a new copper plate is used and there is added in solution in the catholyte, from the beginning of the operation, 1 g of $Cd^{++}$ in the form of previously dissolved cadmium sulfate; at the end of the operation it is found that the copper plate is covered with a gray deposit of metal cadmium that is quite uneven and barely adhering.

In test 3, the operation is as in test 2, with the cadmium sulfate being replaced by zinc sulfate, and thus 580 mg of $Zn^{++}$ is introduced; at the end of the operation, the copper plate is covered with a deposit of zinc that is more even in appearance and more adherent than that of the cadmium.

EXAMPLE 4

In another test in which the cathode is a previously cadmium-coated copper plate, the electrolysis is stopped periodically and the cathode is examined; during the first examination, performed when the current used is about 3 F/mole, the cathode has regained the characteristic red color of copper over almost all its surface; after 4 F/mole, it has taken on a uniform gray appearance characteristic of a cadmium deposit.

EXAMPLES 5 TO 8

A filter press type laboratory cell is used with 5 compartments consisting of two cathode compartments and three anode compartments separated by diaphragms of cation-exchange membranes of the trademark "IONAC 3470"; the anode and cathode compartments are respectively connected to devices for recycling and thermal conditioning of the solutions (peristaltic pump, glass exchanger and glass buffer container).

The total cathode surface is 4 $dm^2$; it consists of two copper plates 1 mm thick, slid into each of the cathode compartments; the anodes are of platinum-coated titanium.

The anolyte is an 18% sulfuric aqueous solution. The nitro alcohol used is 2-nitro-2-methyl-1,3-propanediol.

The operatinn is performed while keeping voltage between poles between 4 and 5.5 volts; the cathode current density varies between 40 A/$dm^2$ (start of the operation) and 15 A/$dm^2$ (end of the operation); table II below gives the other operating conditions and the results obtained; the average current density (Jc) is indicated there.

TABLE II

| EXAMPLES | 5 | 6 | 7 | 8 | |
|---|---|---|---|---|---|
| (R—$NO_2$) | 3.25 | 3.4 | 3.5 | 3.7 | mole/kg |
| $H^+$/RX | 1.2 | 1.3 | 1.15 | 1.1 | |
| $Zn^{++}$/$dm^2$ | 2.5 | 2.4 | 6.5 | 6.5 | millimole $dm^2$ of cathode |
| Jc | 22 | 22 | 20.5 | 19.5 | A $dm^2$ |
| Tension | | | | | |
| mini | 4 | 4.25 | 4.25 | 4.4 | volts |
| maxi | 5 | 5 | 5.4 | 5.3 | volts |
| RC | 99.2 | 99.2 | 98.8 | 99 | molar chemical yield |
| Final Advance | 6 | 5.97 | 5.99 | 5.99 | final advance F mole |
| RF | 70 | 60 | 75 | 78 | overall faradic efficiency |
| AV (RF > 95%) | | 5 | 5.65 | 5.8 | |
| (R—$NH_2$) | 183.5 | 172 | 220.6 | 239 | g per kg of solution |
| (R—NHOH) | 1.6 | 6.7 | 1.9 | 3 | g per kg of solution |
| W | 10.6 | 12.5 | 10 | 9.6 | kwh/kg (energy consumed) |

Test 6 was performed according to test 5 without the addition of $Zn^{++}$; the concentration given in the table results from a posteriori determination by pickling and chemical analysis at the end of test 6; the same for test 7 relative to test 8.

In this table "final Av" means the advance of the reaction at the moment of stopping the operation, i.e., the amount of effective current expressed in faradays per mole of product used.

Av (RF greater than 95%) is the advance of the reaction expressed in the same unit, which was reached before the overall faradic efficiency become less than 95%.

These results clearly show the effect of acidity, example 8 with $H^+$/RX=1.1 giving better result than Example 6 for which $H^+$/RX=1.3.

EXAMPLE 9

In the same cell, a formylation product of nitropropane was treated containing mainly 2-nitro-1-butanol but also nitropropane and 2-nitro-2-ethyl-1,3-propanediol. The results below are given relative to an average molecular weight of nitro derivative deduced from the following type analysis:

| | |
|---|---|
| Nitrobutanol | 86% |
| Nitroethylpropanediol | 11% |
| Nitropropane | 1% |
| $H_2O$ | 1.5% |

A sulfuric aqueous solution containing 3.9 moles/kg of nitro derivative and an excess of acid such as the molar ratio $H^+$/RX=1.15 is treated; the amount in $Zn^{++}$, after putting into electrochemical solution, expressed in mM (millimole) per $dm^2$ of cathode surface is 5.8; the average cathode density is 20.7 A/$dm^2$. The voltage between poles varies during the operation between 5 and 5.7 volts. The operating conditions make it possible to obtain a molar chemical yield of 96.8% and an overall faradic efficiency of 63% for a rate of advance at the end of the operation of 5.95 F/mole, which corresponds to the following final catholyte composition:

$$(R—NH_2)=171.5\ g/kg\ (R—NHOH)=6.5\ g/kg$$

The energy consumption is 14.5 kwh.kg.

The rate of advance, reached before the current efficiency becomes less than 95%, is 4.8 F/mole.

While the invention is described above in relation to certain specific embodiments, it will be understood that many variations are possible, and that alternative materials and reagents can be used without departing from the invention. In some cases such variations and substitutions may require some experimentation, but such will only involve routine testing.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A process for the electrochemical reduction of an aliphatic nitro compound to a corresponding amino compound comprising reducing said aliphatic nitro compound using a bimetallic cathode consisting of a copper support and an active element selected from the group consisting of zinc and cadmium the bimetallic cathode being immersed in a catholyte consisting of an acid and a metal cation of the active element.

2. The process according to claim 1 wherein the active element is zinc.

3. The process according to claim 1 wherein the catholyte is a solution of the nitro compound in a solvent selected from the group consisting of water and a mixture of water and alcohol.

4. The process according to claim 1 wherein the amount of the metal cation present at the beginning of the organic electroreduction operation is from 1 and 10 millimoles per $dm^2$ of active cathode.

5. The process according to claim 4 wherein the amount of the metal cation present at the beginning of the organic electroreduction operation is from 2 to 6 millimoles.

6. The process according to claim 1 wherein the amount of the acid in the catholyte is such that the molar ratio $H^+/RX$, wherein $RX=RNO_2+R—NHOH+RNH_2$, is from 1 to 1.5.

7. The process according to claim 1 wherein the temperature of the catholyte is from 10° C. to 100° C.

8. The process according to claim 7 wherein the temperature of the catholyte is from 20° C. to 60° C.

9. The process according to claim 1 wherein the nitro compound is a nitro alcohol of the formula

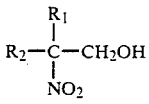

wherein $R_1$ and $R_2$ together or separately are selected from the group consisting of hydrogen, hydroxyalkyl radicals, linear alkyl radicals, and branched chain alkyl radicals.

10. The process according to claim 1 wherein the amino compounds produced are selected from the group consisting of 2-amino-2-methyl-1-propanol; 2-amino, 2-methyl-1,3-propanediol; 2-amino-1-butanol; 2-amino-2-ethyl-1,3-propanediol; tris(hydroxymethyl-)aminomethane.

* * * * *